United States Patent [19]

Fogelberg et al.

[11] 4,145,163

[45] Mar. 20, 1979

[54] VARIABLE CAPACITY WOBBLE PLATE COMPRESSOR

[75] Inventors: Mark J. Fogelberg, Muncie, Ind.; Richard W. Roberts, Lombard, Ill.

[73] Assignee: Borg-Warner Corporation, Chicago, Ill.

[21] Appl. No.: 832,054

[22] Filed: Sep. 12, 1977

[51] Int. Cl.[2] ..... F04B 1/26

[52] U.S. Cl. ..... 417/222

[58] Field of Search ..... 417/270, 222

[56] References Cited

U.S. PATENT DOCUMENTS

| | | | |
|---|---|---|---|
| 3,062,020 | 11/1962 | Heidorn | 417/270 |
| 3,861,829 | 1/1975 | Roberts | 417/270 |
| 4,037,993 | 7/1977 | Roberts | 417/222 |
| 4,073,603 | 2/1978 | Abendschein | 417/270 |

FOREIGN PATENT DOCUMENTS

| | | | |
|---|---|---|---|
| 511640 | 4/1955 | Canada | 417/270 |

*Primary Examiner*—William L. Freeh

*Attorney, Agent, or Firm*—Thomas B. Hunter

[57] ABSTRACT

A controlled, variable displacement wobble plate compressor is provided with means for controlling the capacity by sliding the wobble plate to and fro along the drive shaft axis to vary the effective pumping capacity. The position of the wobble plate along the drive shaft axis is a function of the pressure maintained inside the crankcase, said position being a result of the various forces acting on the pistons, including the underside of the pistons where crankcase pressure is applied.

3 Claims, 4 Drawing Figures

VARIABLE CAPACITY WOBBLE PLATE COMPRESSOR

BACKGROUND OF THE INVENTION

1. Field of the Invention

A rotary wobble plate or swash plate compressor of the type in which the wobble plate is moved to and fro along the drive shaft axis to vary the clearance volume. When the wobble plate is moved away from the cylinder block, the clearance volume is increased, as is the re-expansion loss. This loss is primarily a flow loss; most of the compression power is recovered during re-expansion.

2. Description of the Prior Art

In U.S. Pat. No. 3,861,829 issued to Roberts et al on Jan. 21, 1975, there is described a compressor in which crankcase pressure is controlled to vary the inclination of the wobble plate relative to the drive shaft axis. In the Roberts et al patent, the wobble plate is pivoted at a point spaced from the axis so that there is substantially zero clearance volume at the minimum capacity position.

In French Pat. No. 1,045,463 there is described a hydraulic compressor in which the swash plate is moved back and forth on the drive shaft axis. The position of the wobble plate is controlled by means of discharge pressure acting on a hydraulic cylinder arrangement and the working pistons reacting against a spring.

In U.S. Pat. No. 3,016,837, issued to Dlugos on Jan. 16, 1962, there is described a hydraulic pump of the swash plate type in which the volumetric displacement is varied by moving a series of sleeves surrounding the pistons.

SUMMARY OF THE INVENTION

The present invention relates to a controlled variable capacity swash plate compressor which incorporates certain features of the aforementioned Roberts et al patent, but is greatly simplified with respect to the construction of the compressor and the control mechanism therefor. In the Roberts et al compressor, the swash plate is pivoted so that it can move from a position normal to the drive line axis (the no-stroke position) to another position in which the wobble plate is inclined at a substantial angle to the normal plane (the full-stroke position). Control of the Roberts et al compressor is achieved by varying the pressure within the crankcase, which pressure would normally build up as the result of vapor bypassing the pistons. The position of the swash plate is determined by the resultant of all forces acting thereon. One set of forces is generated by crankcase pressure acting on the underside of each piston; so that by simply varying the crankcase pressure, any intermediate position of the swash plate between the full-stroke and the no-stroke positions can be accomplished.

In the present invention, the swash plate is maintained at a fixed angle relative to the drive shaft axis, but the entire swash plate may be moved axially, i.e. floated, between two fixed positions along said axis. This has the effect of moving the top-dead-center position of the pistons so that there is a substantial clearance volume at the minimum capacity position. Vapor will still be compressed during the compression stroke; but the flow of compressed vapor will be reduced considerably. The associated work of compression will, in part, be recovered during the reexpansion of the vapor early in the intake stroke of the pistons.

While the compressor of the present invention has many cost advantages over Roberts et al, it should be pointed out that the compressor cannot be operated down to substantially zero capacity. It can, however, be designed to operate within a range of about 100% to 15% capacity; and if less than 15% capacity is required, then a clutch can be employed to terminate drive to the compressor under such conditions.

DETAILED DESCRIPTION OF THE INVENTION

Figure 1:
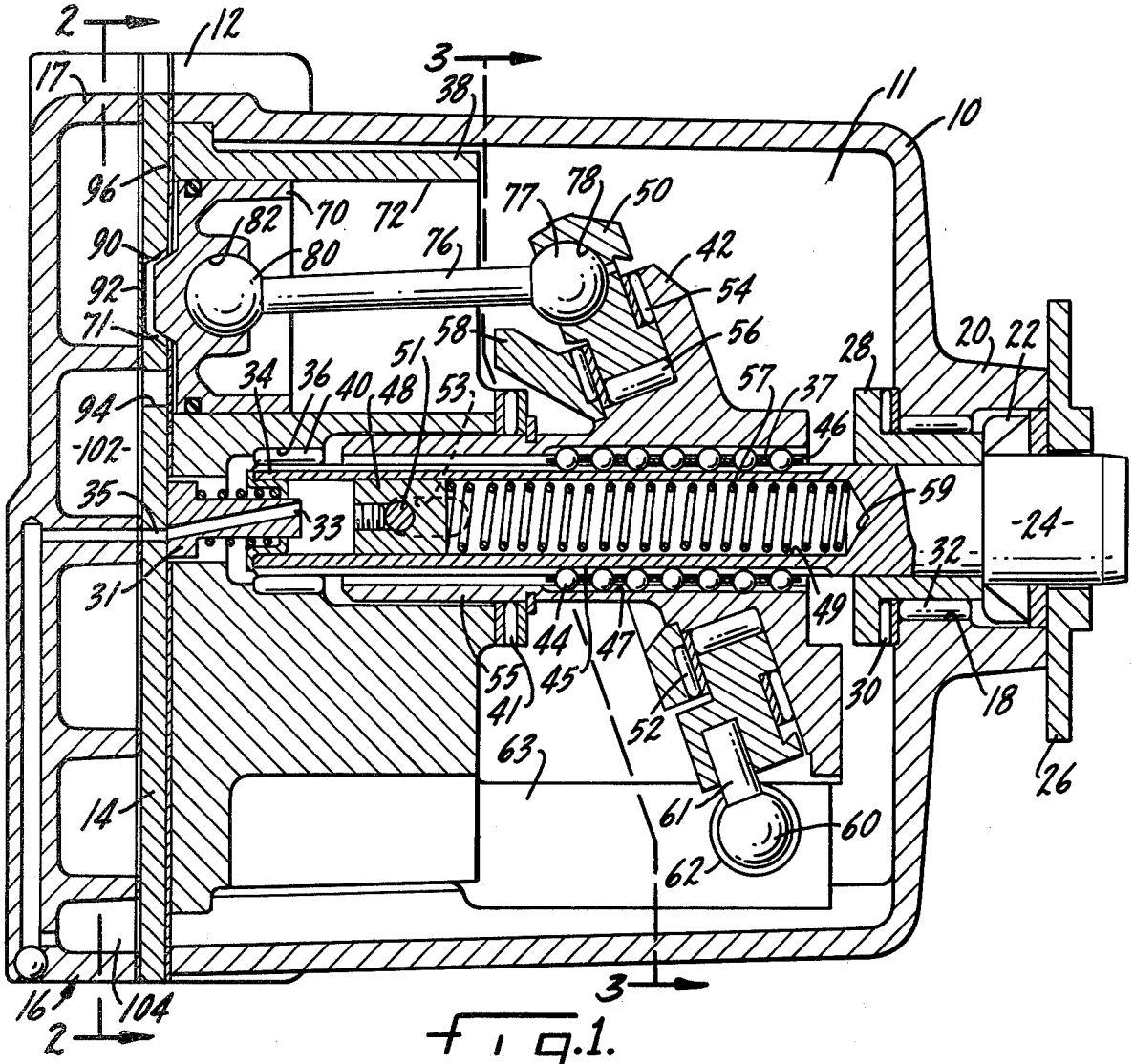
FIG. 1 is a cross-section view of a swash plate compressor constructed in accordance with the principles of this invention.

Referring first to FIG. 1, there is shown a compressor having a housing or casing 10 which is generally bell shaped and has a large open end at 12 which is closed (except for oil distribution passages to be described below) by a valve plate assembly 14 and a head member 16. The opposite end of the compressor (at the right-hand side of FIG. 1) has a bore 18 extending therethrough and an axially extending boss 20 to provide a space for seal assembly 22. Housing 10 thus encloses a sealed volume which will be referred to as the crankcase 11.

A drive shaft 24 extends through a seal plate 26 attached to boss 20 and is adapted to be fitted with a drive means such as a pulley or a direct drive device (not shown). In an automotive application, the compressor would normally be driven by a V-belt from one of the accessory drive pulleys inside the engine compartment. However, in certain applications a direct drive is desired, with or without a clutch member.

Drive shaft 24 is provided with a bearing flange 28 at one end thereof which engages a thrust bearing assembly 30 and a radial bearing assembly 32, the latter being supported in an opening provided in the casing 10. The other end of the drive shaft, indicated at 34, is journalled in a counterbore 36 formed in a cylinder block 38, the latter being supported inside the casing 10 at the left hand end thereof. A radial bearing 40 is received within the counterbore 36 to journal the end of the drive shaft.

A cam member 42 is driven by the drive shaft through a ball spline arrangement in which the series of circumferentially spaced ball elements 44 (see FIG. 3) are arranged within complementary grooves 45, 47, respectively, formed on the outside surface of the drive shaft 24 and on the inside surface of a bore 46 extending through the cam member 42. This permits torque to be transmitted from the drive shaft to the cam member, and also allows axial floating movement of the cam member to and fro on the drive shaft. A sleeve 37, with radial holes, spaces the balls properly and prevents them from moving out of the annular space between the OD of drive shaft 24 and the ID of bore 46. Thrust bearing 41, carried on sleeve section 55 of the cam member, engages the central portion of cylinder block 38 when the cam member moves to its extreme left-hand position. (As viewed in FIG. 1).

A cylindrical plunger 48 is slideable in an axial bore 49 extending part way through drive shaft 24. A cross-pin 51 is secured to the plunger and extends through opposed slots 53 (only one of which is shown) in the drive shaft 24 and is staked to the cylindrical sleeve section 55 of the cam member. A spring 57 is interposed between plunger 48 and the blind end 59 of bore 49 thereby urging the cam member to the left (as viewed in FIG. 1).

Figure 3:
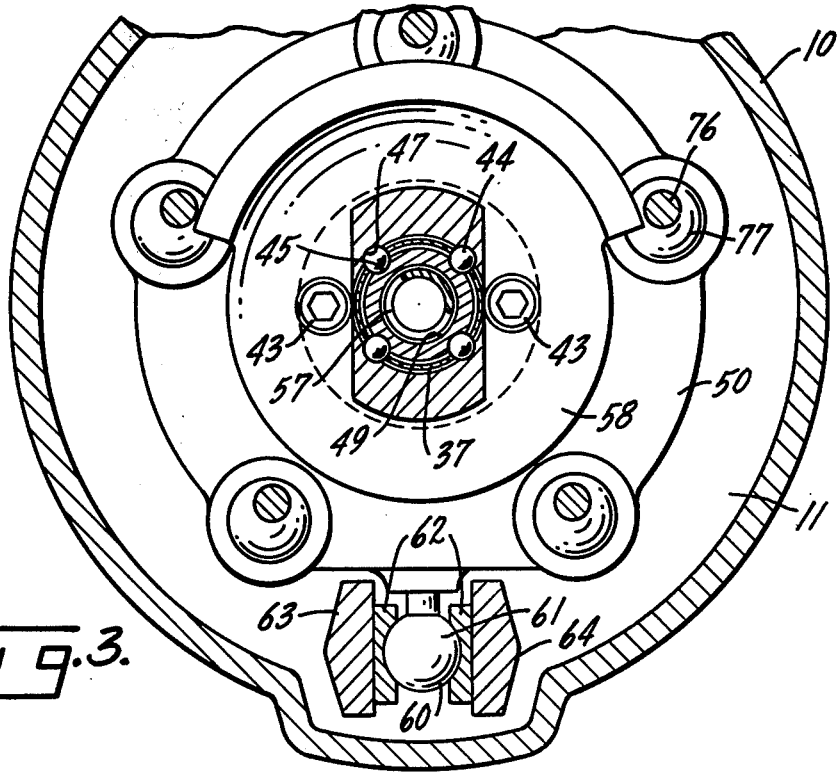
FIG. 3 is a view taken along the plane of line 3—3 of FIG. 1.

Mounted on the cam member 42 is a swash plate 50 which is carried by three sets of bearings including a front thrust bearing assembly 52, a rear thrust bearing assembly 54 and a radial bearing assembly 56. A balance ring 58, piloted on the front portion of the cam member 42, is secured thereto by machine screws 43 (FIG. 3). The front thrust bearing assembly 52 is interposed between the balance ring 58 and the swash plate 50. The swash plate 50 is anchored against rotation by a ball member 60 which is trapped between a pair of pads or slippers 62 (see FIG. 3) movable in a track provided by members 63 and 64 near the lower portion of the casing. It will be noted that this arrangement allows the swash plate degrees of freedom both around its vertical axis and its horizontal axis; but prevents the swash plate from rotating relative to the casing. On the other hand, the bearing assemblies 52, 54 and 56, which support the swash plate on the cam member, permit the cam member to freely rotate relative to the swash plate. Thus, rotation of the cam member causes a wobbling or nutating motion of the swash plate. The swash plate pivots around the axis of pin 61 extending through and securing ball member 60, and also swings in an arcuate path back and forth within the track provided by members 63 and 64.

The swash plate 50 is adapted to drive the pistons 70, which are reciprocatively moveable within cylinders 72 formed in the cylinder block 38 to compress gas or vapor admitted to gas working spaces 71. Connecting rods 76 are each formed with a first ball end 77 received in a complementary socket 78 in the swash plate, and a second ball end 80 captured in a complementary socket 82 in the base portion of the pistons 70.

Figure 2:
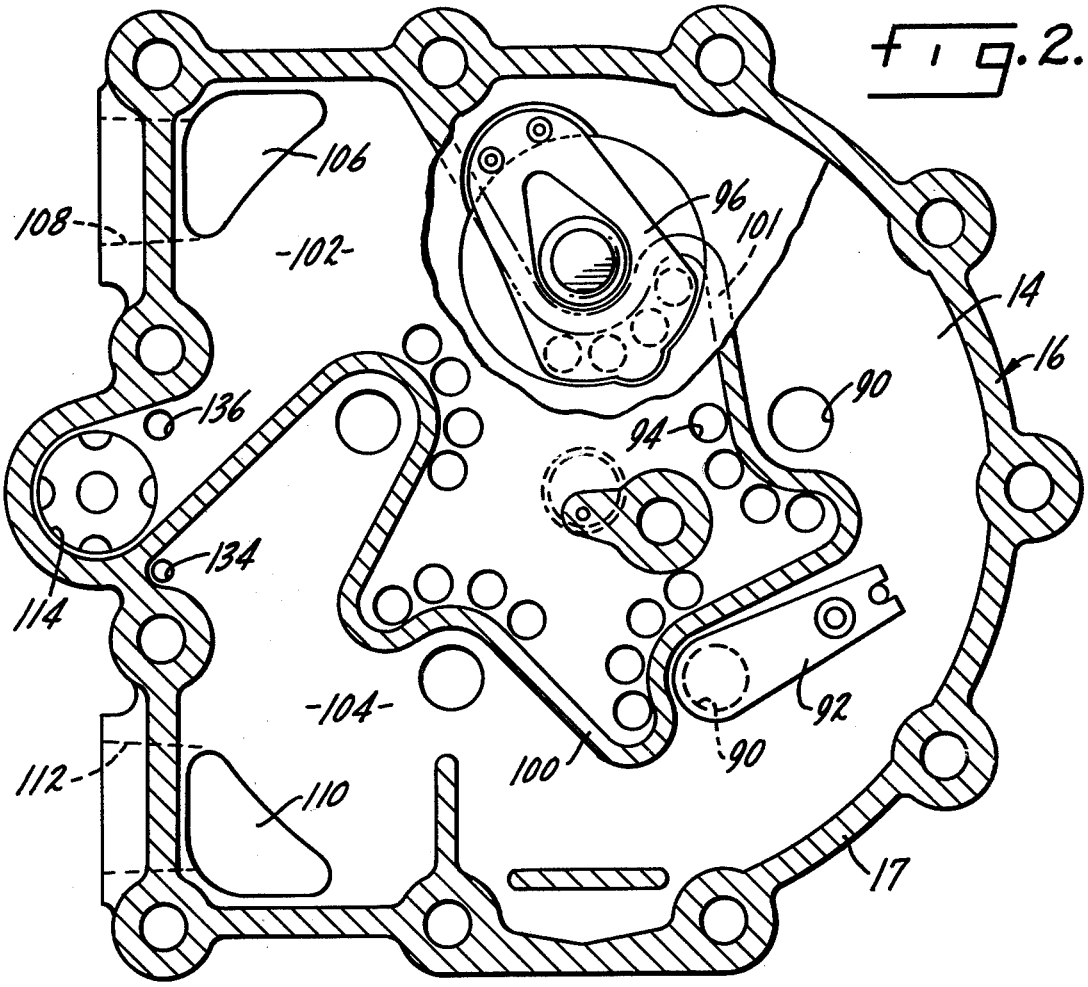
FIG. 2 is a cross-section view of the compressor taken along the plane of line 2—2 of FIG. 1 with a section of the valve plate broken away.

The valve plate 14, as best shown in FIG. 2 is provided with a plurality of discharge ports 90, one for each cylinder, which are covered by flapper type discharge valves 92 (only one typical valve being shown). A series of suction ports 94, arranged in groups adjacent each cylinder, are covered by suction valves 96. A section of the valve plate is shown as broken away to illustrate one of the suction valves 96 which are secured between the underside of valve plate 14 and the top surface of the cylinder block 38. The head member 16 is formed with a rib 100 which provides a continuous wall through the space enclosed by the perimeteral wall 17 of the head member 16 dividing the head into a first, inner chamber 102 in fluid communication with all of the suction ports 94 and a second, outer chamber 104 in fluid communication with the discharge ports 90. In the portion of FIG. 2 that is broken away to show the suction valve, the rib 100 would follow the path of the dotted line designated at 101.

Suction gas is admitted to chamber 102 through a passage 106 from a suction line fitting 108 and thus is in fluid communication with each of the suction ports 94. On the other hand, the discharge ports 90, communicating with chamber 104, allow the discharge gas to be directed through a passage 110 to a discharge gas line fitting 112.

An oil interrupter 31 rotates with the shaft 24 in sealing engagement against the surface of valve plate 14. The inclined hole 33 intermittently lines up with hole 35 to permit oil from discharge cavity 104 to return to the crankcase.

Figure 4:
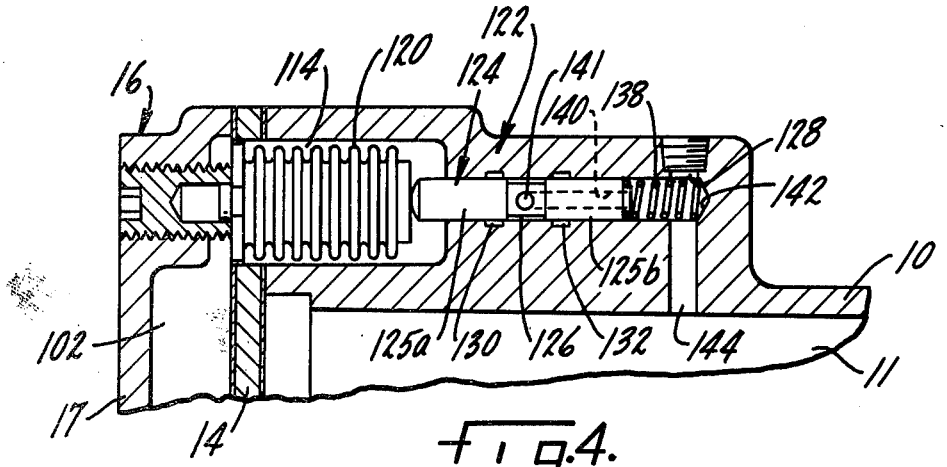
FIG. 4 is a partial cross-section view of the capacity control valve assembly positioned at one side of the housing.

Capacity control of the compressor is achieved by selectively directing fluid at discharge pressure into the crankcase 11 or allowing gas to flow out of the crankcase venting it into the suction zone. Referring to FIGS. 2 and 4, there is a chamber 114 formed along one side of the compressor casing 10 which is adapted to receive a gas-filled, sealed bellows 120 subject to suction pressure. Associated with bellows 120 is a valve assembly 122 comprising a spool 124 having spaced land portions 125*a* and 125*b* and an intermediate groove 126. The spool 124 is moveable within a blind bore 128 which is formed with spaced grooves 130, 132 communicating respectively with discharge pressure and suction pressure through passages 134, 136 (FIG. 2) in the casing. The spool engages the bellows 120 at one end thereof and a spring 138 at the other, said spring being under compression and biasing the spool to the left (as viewed in FIG. 4). A passage 140 and cross-drilled hole 141 connect the annular space between lands 125*a* and 125*b* to the chamber 142 which accommodates spring 138 at the right-hand end of the spool. Chamber 142 is connected with the crankcase 11 through passage 144.

As noted above, the chamber 114 in which bellows 120 is located communicates with suction chamber 102 and is therefore surrounded by suction pressure at all times. Discharge pressure is available at groove 130 while suction pressure is available at groove 132. If suction pressure should increase, thereby indicating a need for additional capacity, the increased pressure will act on the bellows to contract its length. The valve spool 124 will move to the left under the force of spring 138 so that gas at discharge pressure flows from the groove 130 into groove 126 and cross-drilled hole 141, and then through passage 140, chamber 142 and passage 144 into the crankcase 11. Pressurization of the crankcase will force the entire swash plate assembly to slide to the left on the drive shaft axis (aided by spring 57) because of the additional forces acting on the underside of the pistons. An equilibrium point will then be reached where the suction pressure is satisfied and the swash plate will stabilize at this point.

A decrease in suction pressure would indicate a need to reduce capacity of the compressor. The lower suction pressure will cause bellows 120 to expand, moving the spool 124 to the right. This opens a path for gas to flow from crankcase 11 to the suction chamber 102 via the following route: passage 144; chamber 142; passage 140; groove 126; groove 132; and passage 136. As the pressure in the crankcase is reduced, the force on the underside of pistons 70 will be relieved and the swash plate will float to the right (against the force of spring 57), increasing the clearance volume and reducing capacity until the forces are balanced at an equilibrium position.

While this invention has been described in connection with a certain specific embodiment thereof, it is to be understood that this is by way of illustration and not by way of limitation; and the scope of the appended claims should be construed as broadly as the prior art will permit.

What is claimed is:

1. A compressor comprising: means defining a plurality of gas working spaces each having a piston cooperating with suction and discharge ports to compress a gaseous fluid therein; a drive shaft; a cam mechanism driven by said drive shaft; said cam mechanism having a fixed angular position with respect to said drive shaft axis; a swash plate mounted on said mechanism; means for anchoring said swash plate to prevent rotational movement thereof but permitting freedom for limited rotation about two perpendicular axes such that the rotation of the swash plate imparts a nutating motion to said swash plate about the drive shaft axis; means for connecting said pistons to said swash plate; means for mounting said cam mechanism and said swash plate on said drive shaft so that said cam mechanism and said swash plate are moveable axially from a first position wherein said pistons have minimum clearance volume and a second position wherein said pistons have maximum clearance volume; a fluid tight housing enclosing said swash plate such that fluid pressure in said housing may be applied to the underside of said pistons to produce a force urging said swash plate toward said minimum clearance volume position; means for varying the pressure applied to the underside of each said piston to cause said cam mechanism and said swash plate to float to and fro on said drive shaft, said means including a passage connecting the interior of said housing, i.e. the closed crankcase, to a source of gas at discharge pressure; and means for controlling said pressure in response to the capacity requirements of said compressor.

2. A compressor as defined in claim 1 wherein suction pressure is utilized as an indication of said capacity requirements.

3. A compressor as defined in claim 2 wherein said means for varying the fluid pressure in said closed crankcase includes a valve moveable in response to suction pressure to vent fluid pressure from said crankcase to suction when suction pressure decreases and direct discharge pressure into said crankcase when suction pressure increases.

* * * * *

UNITED STATES PATENT OFFICE

CERTIFICATE OF CORRECTION

PATENT NO. : 4,145,163

DATED : March 20, 1979

INVENTOR(S) : Mark J. Fogelberg and Richard W. Roberts

It is certified that error appears in the above-identified patent and that said Letters Patent are hereby corrected as shown below:

Column 5, line 7, before "mechanism" insert -- cam --.

Signed and Sealed this

*Eighteenth* Day of *September 1979*

[SEAL]

*Attest:*

*Attesting Officer*

LUTRELLE F. PARKER

*Acting Commissioner of Patents and Trademarks*